US012540742B2

(12) United States Patent
Schatz et al.

(10) Patent No.: US 12,540,742 B2
(45) Date of Patent: Feb. 3, 2026

(54) DISTRIBUTION TRAY FOR HUMIDIFIER

(71) Applicant: RESEARCH PRODUCTS CORPORATION, Madison, WI (US)

(72) Inventors: Michael Schatz, Madison, WI (US); Nathan Hughes, Madison, WI (US); Joshua Edwards McKune, Madison, WI (US)

(73) Assignee: Research Products Corporation, Madison, WI (US)

( * ) Notice: Subject to any disclaimer, the term of this patent is extended or adjusted under 35 U.S.C. 154(b) by 425 days.

(21) Appl. No.: 18/205,158

(22) Filed: Jun. 2, 2023

(65) Prior Publication Data

US 2023/0392803 A1 Dec. 7, 2023

Related U.S. Application Data

(60) Provisional application No. 63/348,913, filed on Jun. 3, 2022.

(51) Int. Cl.
*F24F 6/04* (2006.01)
*F24F 13/22* (2006.01)

(52) U.S. Cl.
CPC ..... *F24F 6/04* (2013.01); *F24F 13/222* (2013.01)

(58) Field of Classification Search
CPC ..... F24F 6/04; F24F 13/222; F24F 2006/046
USPC ..... 261/106, DIG. 15, DIG. 41
See application file for complete search history.

(56) References Cited

U.S. PATENT DOCUMENTS

| | | | |
|---|---|---|---|
| 2,947,452 | A | 8/1960 | Frohmader et al. |
| 2,948,233 | A | 8/1960 | Scharfe |
| 3,058,726 | A | 10/1962 | Goettl |
| 3,265,371 | A | 8/1966 | Mcgrath |
| 3,464,400 | A | 9/1969 | Wellman |
| 3,464,401 | A | 9/1969 | Mcgrath |
| 5,211,891 | A | 5/1993 | Anoszko |
| 5,718,847 | A | 2/1998 | Koble |
| 5,765,544 | A | 6/1998 | Vigansky |
| 5,851,444 | A | 12/1998 | Hansell et al. |

(Continued)

FOREIGN PATENT DOCUMENTS

| | | |
|---|---|---|
| CN | 107328020 | 11/2017 |
| CN | 213237809 | 5/2021 |

(Continued)

OTHER PUBLICATIONS

AprilAire HYDRLH Hard Water Maintenance Kit for 720 Series Humidifiers. By Amazon.com. Dated Oct. 14, 2024. Found online [Mar. 25, 2025] https://www.amazon.com/AprilAire-HYDRLH-Maintenance-Humidifiers-ReplacemenUdp/BODK2HQ41V (Year: 2024).

(Continued)

*Primary Examiner* — Charles S Bushey
(74) *Attorney, Agent, or Firm* — Foley & Lardner LLP

(57) ABSTRACT

A distribution tray for a humidifier includes a surface, and a flow divider disposed on the surface, where the flow divider is configured to receive a flow of water. The distribution tray also includes a plurality of channels, where each channel within the plurality of channels is fluidly coupled to the flow divider and is configured to receive water from the flow divider. Each channel of the plurality of channels defines a flow path, and each flow path has a varying slope along a length of each channel.

20 Claims, 10 Drawing Sheets

(56) References Cited

U.S. PATENT DOCUMENTS

| | | | | |
|---|---|---|---|---|
| 5,853,625 | A | 12/1998 | Kensok et al. | |
| 5,919,533 | A | 7/1999 | Smith et al. | |
| 5,932,148 | A | 8/1999 | Hansell et al. | |
| 5,948,324 | A | 9/1999 | Cook | |
| 5,971,366 | A | 10/1999 | Smith | |
| D416,994 | S | 11/1999 | Kensok et al. | |
| 6,394,427 | B1 | 5/2002 | Guetersloh et al. | |
| D468,798 | S | 1/2003 | Wilder | |
| 7,950,631 | B2 | 5/2011 | Vasudevan et al. | |
| 8,096,534 | B2 | 1/2012 | Vasudevan et al. | |
| D752,178 | S | 3/2016 | Mjelde | |
| D967,383 | S | 10/2022 | Campbell et al. | |
| D1,027,155 | S | 5/2024 | Campbell et al. | |
| D1,040,987 | S | 9/2024 | Campbell et al. | |
| 2002/0171158 | A1 | 11/2002 | Bloemer | |
| 2006/0208369 | A1 | 9/2006 | Hayden | |
| 2008/0018001 | A1 | 1/2008 | Kammerzell et al. | |
| 2009/0102073 | A1* | 4/2009 | Vasudevan | F24F 6/043 261/106 |
| 2011/0068491 | A1 | 3/2011 | Wang et al. | |
| 2011/0193246 | A1* | 8/2011 | Vasudevan | F24F 6/043 137/15.01 |
| 2023/0213221 | A1 | 7/2023 | Hughes et al. | |
| 2023/0392803 | A1 | 12/2023 | Schatz et al. | |
| 2024/0219046 | A1 | 7/2024 | Hughes et al. | |

FOREIGN PATENT DOCUMENTS

| | | |
|---|---|---|
| WO | WO-00/10695 | 3/2000 |
| WO | WO-2018/227000 | 12/2018 |

OTHER PUBLICATIONS

Honeywell Frame and Tray Assembly for HE200 HE 250. By Supplyhouse.com. Dated Feb. 24, 2024. Found online [Mar. 25, 2025] https://web.archive.org/web/20240224004839/https://www.supplyhouse.com/Honeywell-Home-50041861-002- Frame-and-Tray-Assembly-for-HE200-H E250 (Year: 2024).

* cited by examiner

DISTRIBUTION TRAY FOR HUMIDIFIER

CROSS-REFERENCE TO RELATED APPLICATIONS

This application claims the benefit of and priority to U.S. Provisional Patent Application Ser. No. 63/348,913, filed Jun. 3, 2022, the entirety of which is hereby incorporated by reference in its entirety.

BACKGROUND

The present disclosure relates generally to the field of humidifiers. More specifically, the disclosure relates to a distribution tray for an evaporative humidifier.

Humidifier distribution trays collect water flowing from an inlet stream, where the distribution tray divides and distributes the stream to flow over an area (e.g., water panel). The distribution tray typically retains the received water until the water reaches one or more drain ports in the tray, where the water may then separate and flow from the tray to the area. Often, water flow from the inlet stream may be inefficiently divided by the distribution tray or may unevenly flow out of the distribution tray. The distribution tray may also not drain completely when the inlet stream is stopped. This can lead to scale formation within the distribution tray, contribute to bacterial growth, and reduce effectiveness of the humidifier function.

Accordingly, it would be advantageous to provide a distribution tray that is structured to securely receive water from an inlet stream, facilitate even flow and distribution of the water from the inlet stream, and drain completely when not in operation.

SUMMARY

One embodiment of the disclosure relates to a distribution tray for a humidifier. The distribution tray includes a surface, and a flow divider disposed on the surface, where the flow divider is configured to receive a flow of water. The distribution tray also includes a plurality of channels, where each channel is fluidly coupled to the flow divider and is configured to receive water from the flow divider. Each of the plurality of channels defines a flow path, and where each flow path has an increasing slope along a length of each channel.

In various embodiments, the distribution tray is rectangular in shape, having a first side, a second side opposite the first side, a third side substantially perpendicular to the first side, and a fourth side opposite the third side. In some embodiments, a first channel within of the plurality of channels extends toward the third side and a second channel of the plurality of channels extends toward the fourth side. In other embodiments, the flow divider is disposed at a midpoint between the first side and the second side. In yet other embodiments, the flow divider has one of a conical shape or a spherical shape. In various embodiments, the slope of the flow path is greatest at an end of the channel. In some embodiments, the flow path is configured to curve in a first direction and a second direction, the second direction being perpendicular to the first direction.

Another aspect of the present disclosure relates to a distribution tray for a humidifier. The distribution tray includes a surface enclosed by a retaining wall and a flow divider disposed on the surface at a midpoint between opposite sides of the retaining wall, where the flow divider is configured to receive a flow of water. The flow divider is fluidly coupled to a plurality of channels, where each of the plurality of channels is disposed equidistantly about a circumference of the flow divider and is configured to receive a portion of the flow of water. Each of the plurality of channels includes a leaf shaped portion, where the leaf shaped portion defines a flow path, and where the flow path has a varying slope along a length of the leaf portion.

In various embodiments, the slope is greatest at a terminal end of each of the leaf shaped portions. In some embodiments, the flow path corresponding to a longest of the plurality of channels has a greatest radius of curvature nearest the flow divider and the flow path corresponding to a shortest of the plurality of channels has a smallest radius of curvature nearest the flow divider. In other embodiments, the plurality of channels includes six channels. In yet other embodiments, each of the plurality of channels is formed between two splitter walls, where each splitter wall extends from the flow divider toward the retaining wall. In various embodiments, the leaf portion includes a plurality of ridges disposed along a surface of the leaf portion, the plurality of ridges configured to facilitate water beading. In some embodiments, the distribution tray includes a treated surface, where the treated surface is configured to reduce a water contact angle such that the treated surface has a lowered surface energy as compared to a remaining portion of the distribution tray.

Yet another aspect of the present disclosure relates to a humidifier. The humidifier includes a conduit configured to facilitate water flow from a water supply and a distribution tray fluidly coupled to the conduit. The distribution tray includes a surface enclosed by a retaining wall, and a flow divider disposed on the surface, where the flow divider is configured to receive water from the conduit. The distribution tray also includes a plurality of channels, where each of the plurality of channels is defined between two splitter walls. Each of the plurality of channels is configured to receive a portion of the water and each of the plurality of channels includes a leaf shaped portion. The leaf shaped portion defines a flow path, where the flow path has a varying slope along a length of the leaf portion.

In various embodiments, an outlet of the conduit is configured to be placed between ends of the two splitter walls. In some embodiments, each of the ends of the two splitter walls includes a shoulder, the shoulder being configured to prevent downward motion of the outlet. In other embodiments, the flow divider is conical in shape. In yet other embodiments, a position of an apex of the flow divider relative to the outlet is based on a height of the ends of the two splitter walls. In various embodiments, the conduit is an elbow. In some embodiments, the distribution tray further includes a recess disposed adjacent a side of the retaining wall, where the recess is configured to receive an anchor portion of the conduit.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
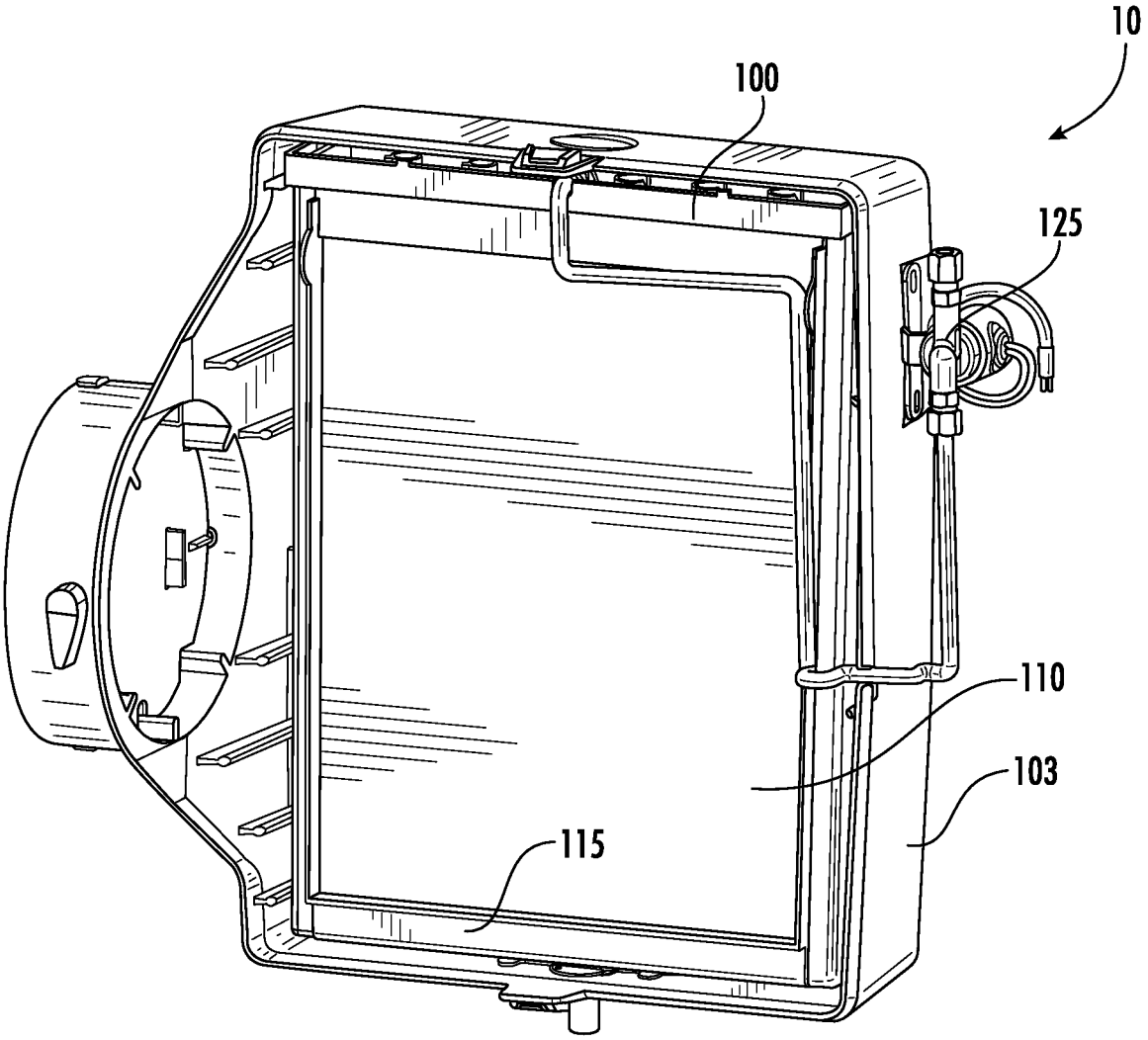
FIG. 1 is a perspective view of a humidifier assembly, according to an exemplary embodiment.

Referring to FIG. 1, a humidifier assembly 10 is shown, according to an exemplary embodiment. The humidifier assembly 10 is configured to increase humidity within a space (e.g., in response to one or more commands from a controller operably coupled to the humidifier assembly 10) and includes a housing 103, within which a distribution tray 100 is fluidly coupled to a water supply 105, and a water panel 110. As shown, the water supply 105, which may include one or more fluid conduits (e.g., pipes), receives water at an inlet 125 (e.g., from a water source within a building within which the humidifier assembly 10 is disposed). The water supply 105 provides water to the distribution tray 100, which then distributes the water across the water panel 110. Residual water from the water panel 110 may then flow to the drainage tray 115, which collects the water and may facilitate water flow to one or more drainage conduits, which route the collected water away from the humidifier assembly 10.

Figure 2A:
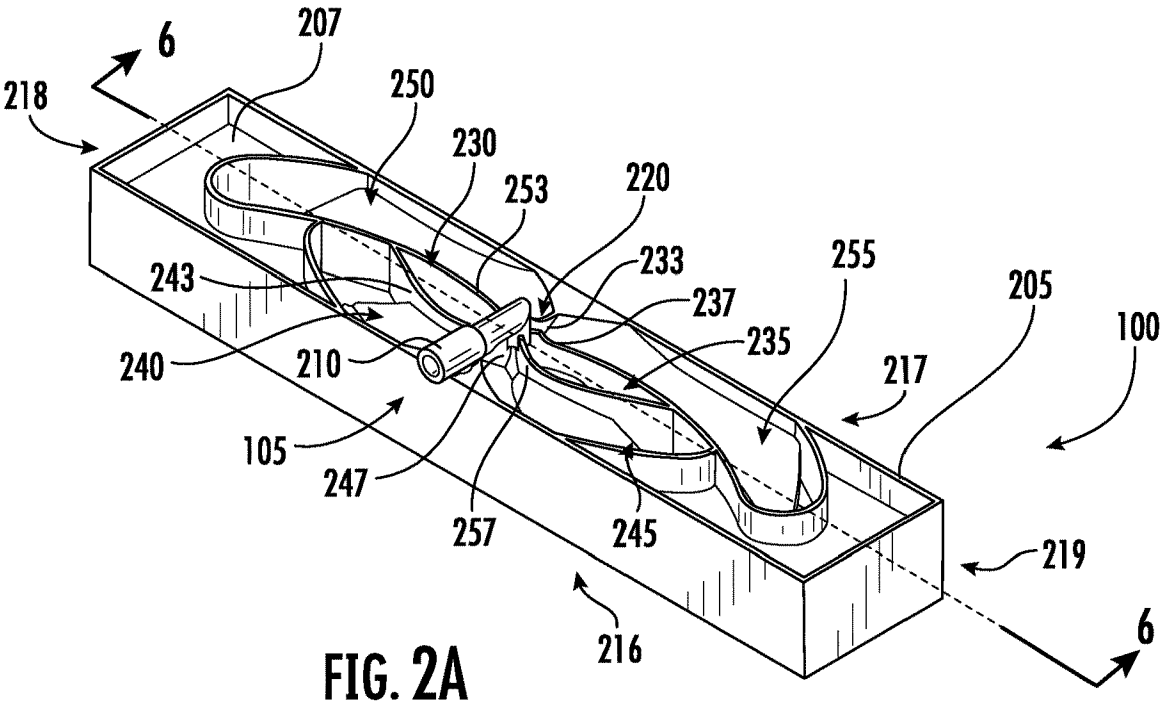
FIG. 2A is a top perspective view of the distribution tray and the water supply within the humidifier assembly of FIG. 1, according to an exemplary embodiment.

FIG. 2A shows a perspective view of the distribution tray 100, which is coupled to and receives water from the water supply 105. In some embodiments, the distribution tray 100 includes a support surface 207, which is surrounded by a retention wall 205 that extends upward in a substantially perpendicular direction to a plane defined by the surface 207. In other embodiments, the retention wall 205 extends in a non-perpendicular direction relative to a plane defined by the surface 207. For example, the retention wall 205 may extend upward at an angle (e.g., 30 degrees, 45 degrees, 120 degrees, etc.) relative to a plane defined by the surface 207. In various embodiments, the support surface 207 and the retention wall 205 may be rectangular in shape. As shown in FIG. 2A, the retention wall 205 may be rectangular in shape, having a first side 216 disposed opposite a second side 217 and a third side 218 opposite a fourth size 219. In other embodiments, the support surface 207 and the retention wall 205 may have any suitable shape for facilitating and distributing water flow received from the water supply 105.

As shown, the distribution tray 100 is coupled to the water supply 105, which includes at least one conduit 210. In various embodiments, the conduit 210 may be an elbow fitting, having a first portion oriented in a direction substantially parallel to the surface 207 and a second portion coupled to (or integrally connected with) the first portion, where the second portion extends away from the first portion and toward the surface 207 in a direction substantially perpendicular to both the first portion and the surface 207. In other embodiments, the conduit 210 may be a tube, hose, fitting, pipe, or any other suitable component for facilitating water flow therethrough. As shown in FIG. 2A, the conduit 210 may be coupled to or disposed adjacent to the first side 216 of the retention wall 205 and may extend to a flow divider or receiving portion 220 disposed on the surface 207. Accordingly, water from the water supply 105 may flow through the conduit 210 and may be received by the distribution tray 100 at the flow divider 220. In various embodiments, the flow divider 220 may be disposed within a substantially central region of the distribution tray 100 such that it is positioned equidistantly from opposing outermost edges of the retention wall 205 (i.e., disposed at or near a midline between the first and second sides 216, 217 and between the third and fourth sides 218, 219). In other embodiments, the flow divider may be disposed at any suitable location on the surface 207.

Figure 2B:
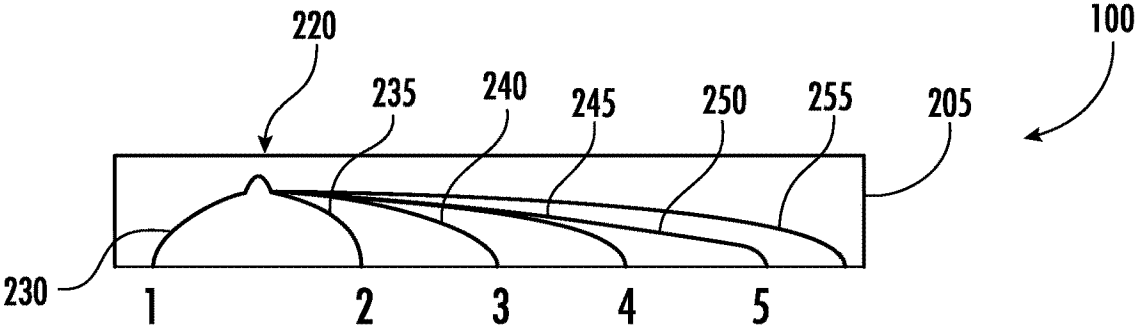
FIG. 2B is a schematic representation of a side cross-sectional view of the distribution tray illustrating an alternate arrangement of channels.

The distribution tray 100 includes a plurality of channels, which are each fluidly coupled to the flow divider 220 and are structured to facilitate water flow through the distribution tray 100 to one or more corresponding outlets. As shown in FIG. 2A, the distribution tray 100 may include six channels disposed within the surface and extending outwardly from the flow divider 220, where each channel terminates at an opening disposed through the surface 207. In some embodiments, the six channels may be equidistantly arranged about a circumference of the flow divider 220. In various embodiments, the six channels may be symmetrically arranged within the distribution tray 100 such that a configuration of channels on a first side of the flow divider 220 mirrors a configuration of channels on a second side of the flow divider 220. In various embodiments, the channels may be arranged to include a first pair of channels, having a first channel 240 extending from the flow divider 220 toward the third side 218 of the distribution tray 100 and a second channel 245 extending from the flow divider 220 toward the fourth side 219 of the distribution tray 100, where the first channel 240 and the second channel 245 are disposed in a mirroring configuration. The channels may also include a second pair of channels, having a third channel 250 extending from the flow divider 220 toward the third side 218 of the distribution tray 100 and a fourth channel 255 extending from the flow divider 220 toward the fourth side 219 of the distribution tray 100, where the third channel 250 and the fourth channel 255 are disposed in a mirroring configuration. The channels may also include a third pair of channels, having a fifth channel 230 extending from the flow divider 220 toward the third side 218 of the distribution tray 100 and a sixth channel 235 extending from the flow divider 220 toward the fourth side 219 of the distribution tray 100, where the fifth channel 230 and the sixth channel 235 are disposed in a mirroring configuration. In other embodiments the channels 240, 245, 250, 255, 230, and 235 may be asymmetrically arranged within the distribution tray 100. For example, the flow divider 220 may be disposed closer to the side 218 than the side 219 such that a length of each of the channels 230, 240, 250 is smaller than a corresponding length of each of the channels 235, 245, and 255. In other embodiments, the flow divider 220 may be disposed closer to the side 219 than the side 218 (or vice versa) and/or closer to one of the sides 216 or 217 than the other of the sides 216 or 217. In yet other embodiments, the channels 230, 235, 240, 245, 250, and 255 may each have different lengths and/or curvatures and may be asymmetrically arranged about the flow divider 220 (e.g., such as shown in FIG. 2B).

As shown in FIG. 2A, the first and second channels 240, 245 may be disposed closest to the first side 216 of the retention wall 205, and the third and fourth channels 250, 255 may be disposed closest to the second side 217 of the retention wall 205 opposite the first side 216. The fifth and sixth channels 230, 235 may be disposed between the first and second channels 240, 245 and the third and fourth channels 250, 255. As shown in FIG. 2A, each of the channels 240, 245,250, 255, 230, and 235 are formed between splitter walls, which extend from the flow divider 220, and the retention wall 205. As shown, the first channel 240 is formed between the splitter walls 247 and 243, and the first side 216 of the retention wall 205. Likewise, the second channel 245 is formed between the splitter walls 247 and 257, and the first side 216 of the retention wall 205. The fifth channel 250 is formed between the splitter walls 233 and 253, and the second side 217 of the retention wall 205. The sixth channel 255 is formed between the splitter walls 233 and 237 and the second side 217 of the retention wall 205. The third channel 230 is formed between the first channel 240 and the fifth channel 250, disposed between the splitter walls 253 and 243. Similarly, the fourth channel 235 is formed between the second channel 245 and the sixth channel 255, disposed between the splitter walls 237 and 257. In addition to facilitating division of water flow received at the flow divider 220, each of the splitter walls 243, 247, 253, 257, 233, and 237 may provide structural support to the distribution tray 100 (i.e., by resisting axial and/or bending loads applied to the distribution tray 100).

Although the figures depict the distribution tray 100 including six splitter walls and six channels, in various embodiments, the distribution tray 100 may include any number of splitter walls and/or channels. In some embodiments, a number of splitter walls and/or channels may be based on a size of the distribution tray 100. In various embodiments, each of the channels (or pairs of channels) may have a same length. In other embodiments, each of the channels (or pairs of channels) may have different lengths. As shown in FIG. 2A, the third and fourth channels 250, 255 (which constitute the second pair of channels) may have a length that is longer than a length of each of the other channels 240, 245, 230, and 235, such that ends of the channels 250, 255 terminate closer to the respective sides 218, 219 of the retention wall 205 as compared to ends of the other channels. The fifth and sixth channels 230, 235 (which constitute the third pair of channels) may have a length that is shorter than a length of each of the other channels 240, 245, 250, and 255, such that ends of the channels 230, 235 terminate furthest from the respective sides 218, 219 of the retention wall 205 as compared to respective ends of the other channels. Finally, the first and second channels 240, 245 (which constitute the first pair of channels) may have a length that is greater than the length of the channels 230 and 235, and less than the length of the channels 250 and 255.

Figure 3:
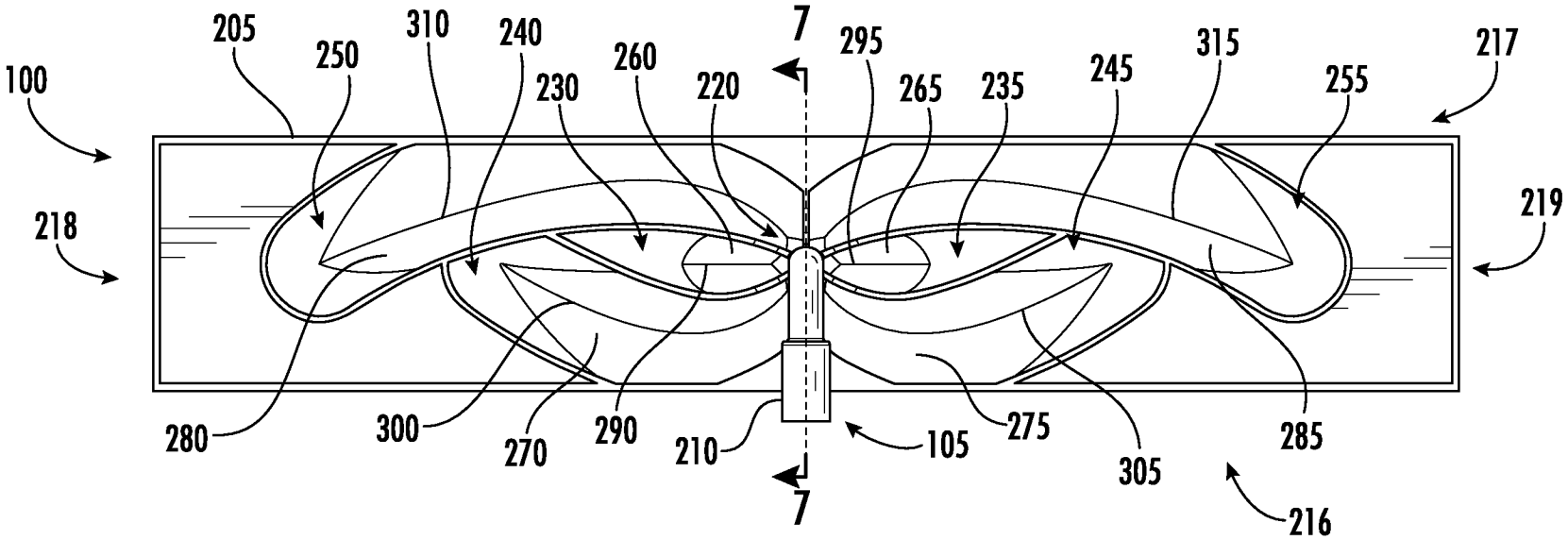
FIG. 3 is a top view of the distribution tray of FIG. 2A.

As shown in FIG. 3, the first and second channels 240, 245 may respectively extend outwardly from the flow divider 220 toward the sides 218, 219, and both curve toward the second side 217. The third and fourth channels 250, 255 may respectively extend outwardly from the flow divider 220 toward the sides 218, 219, and both curve toward the first side 216. The fifth and sixth channels 230, 235 may respectively extend outwardly from the flow divider 220 toward the sides 218, 219, and may curve toward the second side 217, as shown in FIG. 3. In other embodiments, the fifth and sixth channels 230, 235 may curve toward the first side 216. In yet other embodiments, the fifth and sixth channels 230, 235 may instead not curve and solely extend toward the respective sides 218, 219.

Each of the channels includes a concave feature or a leaf (i.e., a leaf-shaped portion), which directs flow from the flow divider 220 through the respective channel to an outlet disposed at a terminal end of that channel, where water flowing out of each channel outlet may leave the distribution tray 100 and may flow to one or more components within the humidifier 10 (e.g., the water panel 110). As shown in FIG. 3, the first and second channels 240, 245 respectively include first and second leaves 270, 275, which extend from the flow divider 220. Similarly, the third and fourth channels 250, 255 respectively include third and fourth leaves 280, 285. Lastly, the fifth and sixth channels 230, 235 respectively include fifth and sixth leaves 260, 265.

Each leaf 270, 275, 280, 285, 260, 265 is bisected by a respective flow path 300, 305, 310, 315, 290, 295, where each flow path defines a vertically lowest point for each longitudinal position of the leaf formed between upwardly extending opposing sides of the leaf (i.e., where each leaf effectively forms a v-shaped cross section and each flow path defines the lowest point of the v shape). Accordingly, water flowing from the flow divider 220 will flow along the flow paths 300, 305, 310, 315, 290, 295. In various embodiments, a slope of the opposing sides of each of the leaves 270, 275, 280, 285, 260, 265 may vary along the length of each leaf. For example, a slope of each of the opposing sides of the leaves 270, 275, 280, 285, 260, 265 may decrease as a distance from a base of the flow divider 220 increases (i.e., such that a v shape formed by a cross-section of each of the leaves widens as a distance from the flow divider 220 increases).

In various embodiments, the slope of each leaf 270, 275, 280, 285, 260, 265 may be structured such that a terminal end of each leaf is flatter (i.e., having a smaller slope) as compared to an end of the leaf adjacent the flow divider 220. Accordingly, the leaves 270, 275, 280, 285, 260, 265 may reduce the surface area of the leaf which is in contact with water which reduces the adhesive forces between the water and the surface of the distribution tray 100, thereby encouraging water to flow out of the distribution tray 100. In various embodiments, a slope of one or more of the leaves 270, 275, 280, 285, 260, 265 nearest the flow divider may be approximately 45 degrees, whereas the slope nearest a terminal end of one or more of the leaves 270, 275, 280, 285, 260, 265 may be approximately 60 degrees.

In some embodiments, a degree or radius of curvature of each of the flow paths 300, 305, 310, 315, 290, 295, which have lengths corresponding to lengths of their respective channels 240, 245, 250, 255, 230, 235, may vary depending on the length of each leaf. For example, leaves greatest in length (e.g., leaves 280, 285) may have the largest radius of curvature and leaves shortest in length (e.g., leaves 260, 265) may have the smallest radius of curvature.

Figure 4A:
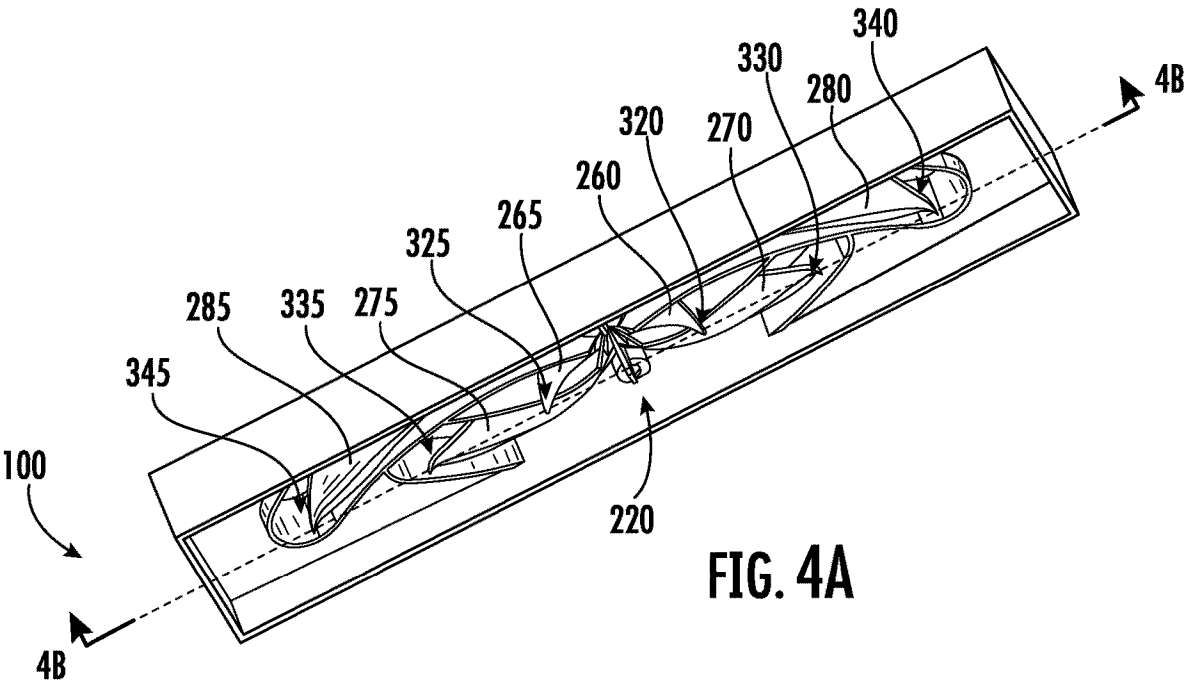
FIG. 4A is a bottom perspective view of the distribution tray of FIG. 2A.
Figure 4B:
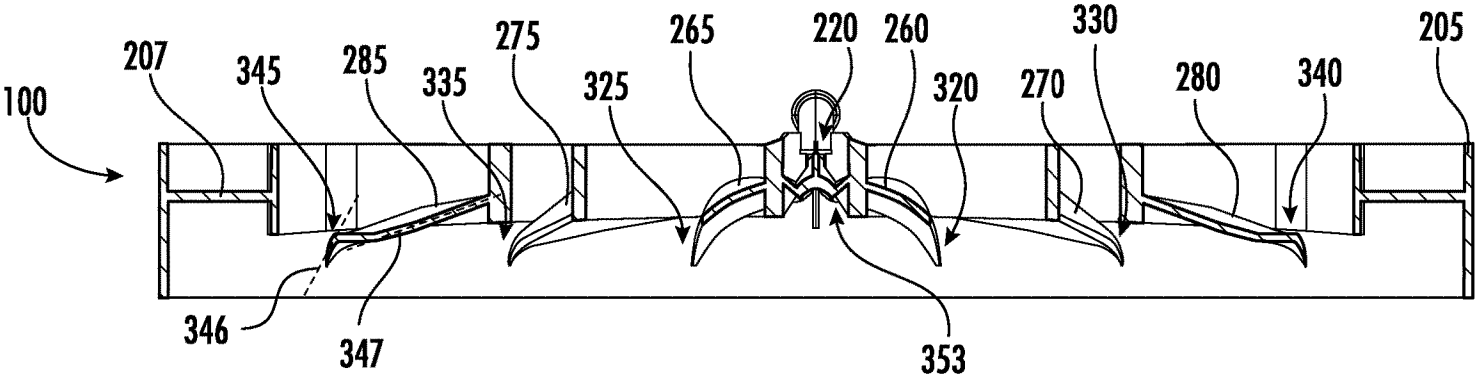
FIG. 4B is a side cross-sectional view of the distribution tray of FIG. 2A, taken along line 4B-4B of FIG. 4A.

As shown in FIG. 4B, which is a cross-sectional view of the distribution tray 100 taken along line 4B-4B of FIG. 4A. To facilitate water flow through the distribution tray 100, each leaf 270, 275, 280, 285, 260, 265 extending from the base 353 of the flow divider 220 distally increases in slope (e.g., the magnitude of the slope increases as the distance from the base 353 increases). For example, as shown in FIG. 4B, a first slope 347 at a first position of the leaf 285 disposed closer to the base 353 is smaller than a second slope 346 at a second position of the leaf 285 further from the base 353 (and closer to the tip 345), where the slope 347 is defined as a line tangent to a curve. Because each leaf 270, 275, 280, 285, 260, 265 is disposed between splitter walls, which form their respective channels 240, 245, 250, 255, 230, 235, each leaf 270, 275, 280, 285, 260, 265 may be curved in two directions-curved (i.e., sloped) with respect to an axial direction of the distribution tray 100 (i.e., in a direction perpendicular to the surface 207) and curved with respect to a longitudinal direction of the distribution tray 100 (i.e., in a plane parallel to the surface 207).

As shown in FIG. 4A, a terminal end of each of the leaves 270, 275, 280, 285, 260, 265 may respectively form pointed tips 330, 335, 340, 345, 320, 325, which each curve downward (i.e., in a direction perpendicular to the surface 207 and away from the conduit 210), where the radius of curvature of each tip is less than the radius of curvature elsewhere along the leaf. The end of each leaf terminates such that the end is approximately perpendicular to surface 207 and away from the conduit 210 to facilitate the acceleration of water flow downward and away from the distribution tray 100. The pointed tips 330, 335, 340, 345, 320, and 325 also aid in droplet formation by using gravity to manipulate the adhesive forces between the water and the distribution tray 100, and the cohesive forces between water molecules. The reduction in surface area of each of the leaves 270, 275, 280, 285, 260, 265 (i.e., which respectively form the pointed tips 330, 335, 340, 345, 320, and 325) in contact with water flowing—through the flow paths 300, 305, 310, 315, 290, 295 encourages water to bead and pool. As the flow of water continues down the pointed tips 330, 335, 340, 345, 320, and 325, the surface area of the water in contact with the distribution tray 100 continues to reduce, due to the cohesive forces between water molecules, causing droplet formation. This process continues until the flow of water in the flow paths 300, 305, 310, 315, 290, 295 reach the end of the pointed tips 330, 335, 340, 345, 320, and 325 where the gravitational force exceeds the adhesive forces between the water droplets to the distribution tray 100 causing the droplets to fall.

In various embodiments, one of more of the leaves 270, 275, 280, 285, 260, 265 may be structured to have a surface texture that facilitates water flow out of the distribution tray 100. In some embodiments, one or more of the leaves 270, 275, 280, 285, 260, 265 may include a plurality of ridges disposed within a top surface thereof, where the ridges facilitate water beading. In other embodiments, one or more of the leaves 270, 275, 280, 285, 260, 265 may include fibers (e.g., resembling hair) coupled to or integrally formed with a top surface of the leaves. In some implementations, the ridges or fibers may be arranged on the surface of one or more of the leaves 270, 275, 280, 285, 260, 265 in an overlapping fashion. For example, the ridges or fibers may be arranged in a configuration resembling shingles (i.e., on a building or structure). In yet other embodiments, one or more of the leaves 270, 275, 280, 285, 260, 265 may be treated with one or more surface treatments, such as via plasma vapor, which lowers surface energy to promote droplet formulation. In some embodiments, the leaves 270, 275, 280, 285, 260, 265 may be manufactured to have a texture (e.g., ridges, ribs, dimples, etc.) as part of a molding process. In other embodiments, the leaves 270, 275, 280, 285, 260, 265 may be treated with a secondary coating, which is applied after the part is molded.

Figure 5:
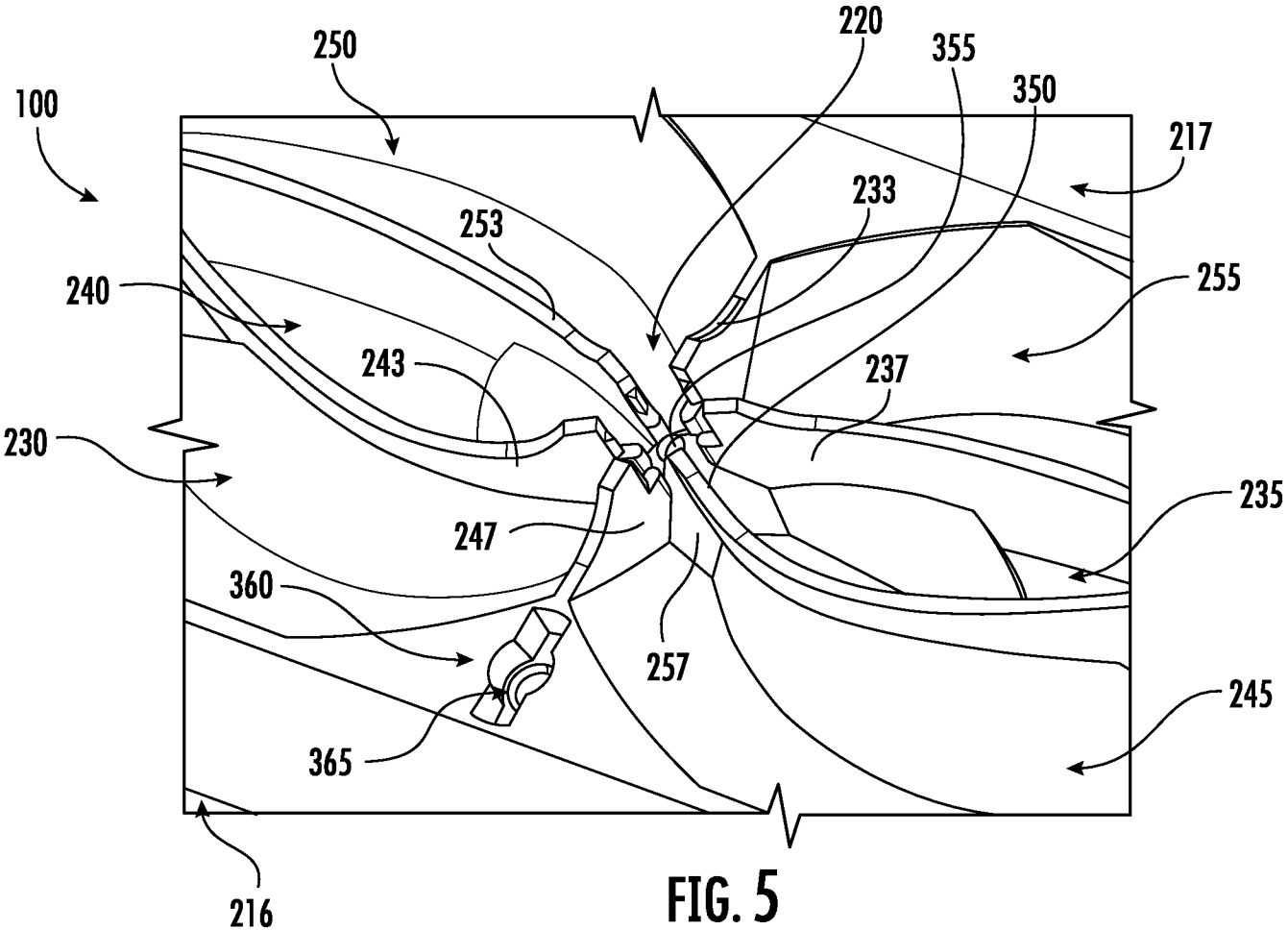
FIG. 5 is a top perspective view of the distribution tray of FIG. 2A near a receiving portion.

In various embodiments, the flow divider 220 may be configured to receive the conduit 210, where the flow divider 220 structure is arranged concentrically with the conduit 210 so as to partially obstruct water flow through the conduit 210 and force division of the water stream into each of the channels 240, 245, 250, 255, 230, 235. As shown in FIG. 5, the flow divider 220 includes a rounded body 350, having an apex 355 that extends upward from the surface 207, where the body 350 is structured to facilitate substantially equal water shed about a circumference of the body 350 such that water received by the flow divider 220 is evenly distributed among the channels 240, 245, 250, 255, 230, 235. In various embodiments, the rounded body 350 is structured to extend at least partially into an outlet of the conduit 210 such that the apex 355 is positioned within an interior of the conduit. This overlap forces water flow from the conduit 210 to be drawn to flow onto the body 350, where it is evenly divided into each of the channels 240, 245, 250, 255, 230, 235. In some embodiments, the conical body 350 is structured such that the apex 355 is disposed at a substantially same height (i.e., is planar to) the outlet of the conduit 210. In other embodiments, the rounded body 350 is structured such that the apex 355 is disposed at a lower height (i.e., is spaced from) the outlet of the conduit 210. In yet other embodiments, the conical body 350 may be structured to have any suitable height and/or diameter such that the apex 355 is disposed at any position relative to the outlet of the conduit 210 so long as the body 350 and/or the apex 355 impinges water flow through the outlet to force substantially even division of water flow into each of the channels 240, 240, 250, 255, 230, 235 without obstructing or degrading flow through the conduit 210. In some embodiments, the body 350 may be spherical in shape. In other embodiments, the body 350 may be conical in shape.

In various embodiments, the distribution tray 100 may include one or more locating features to facilitate secure fluid coupling of the conduit 210 to the distribution tray 100 (to thereby facilitate efficient water flow therethrough). As shown in FIG. 5, the distribution tray 100 may include a recess 360 disposed near or adjacent to the first side 216 and the splitter wall 247, where the recess 360 facilitates placement and coupling of the conduit 210 to the distribution tray 100. The recess 360 may include a socket 365, which is configured to receive one or more locating features (e.g., protrusions) coupled to or integrally formed with the conduit 210. In various embodiments, the socket 365 may facilitate at least one of a snap fit, friction fit, or press fit with a portion of the conduit 210.

Figure 6:
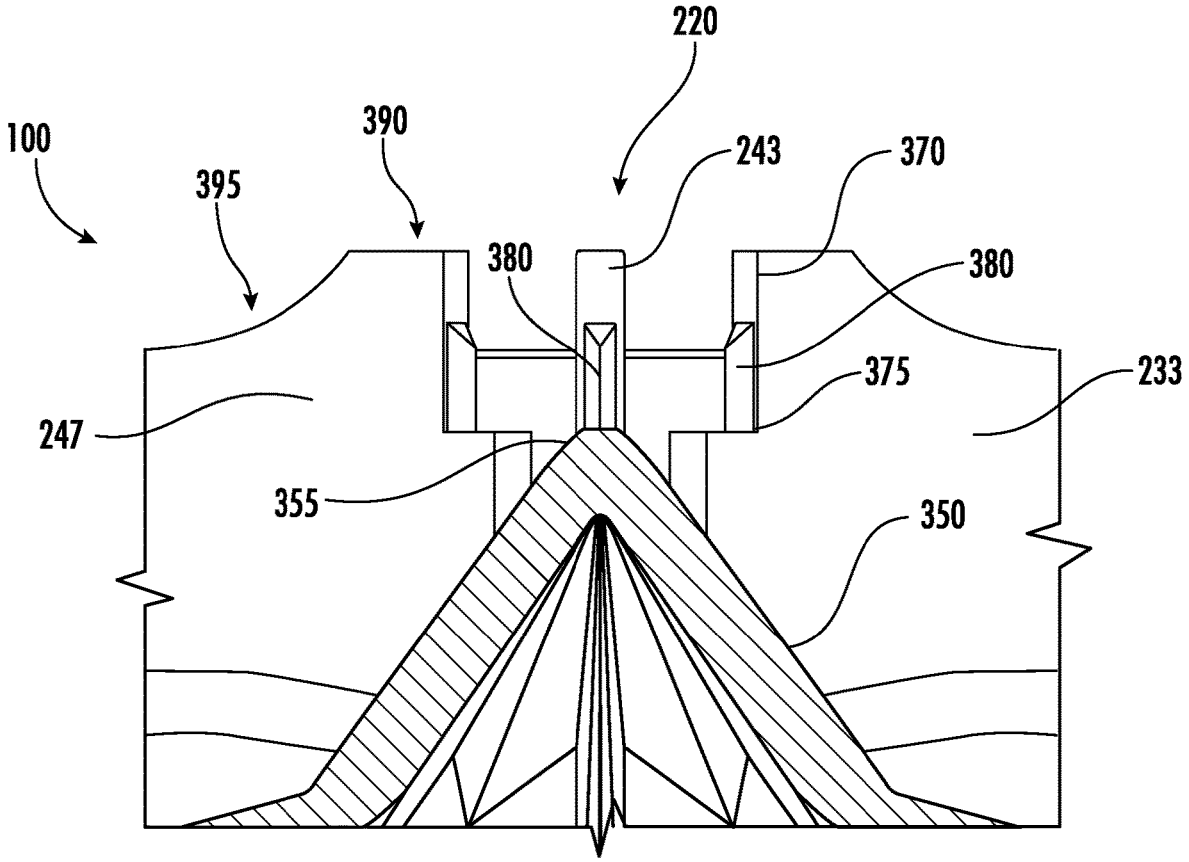
FIG. 6 is a side cross-sectional view near the receiving portion of FIG. 5 taken along line 6-6 of FIG. 2A.

As shown in FIG. 6, the distribution tray 100 may also be structured such that the splitter walls 243, 247, 253, 257, 233, 237 include one or more features to facilitate locating the conduit 210 such that water flows therefrom to the flow divider 220. It should be noted that although FIG. 6 depicts splitter walls 247 and 233, the features shown on splitter walls 247, 233 are shared among all the splitter walls 243, 247, 253, 257, 233, 237. As shown, the splitter walls 233, 247 are structured to include a shoulder feature 375 disposed at an end 370 adjacent the flow divider 220, which is configured to engage with an end of the conduit 210 when the conduit 210 is coupled to or placed on the distribution tray 100. The shoulder feature 375 extends in outwardly in a horizontal direction and is configured to prevent downward movement of the outlet of the conduit 210. In various embodiments, a height of the shoulder feature 375 determines whether the apex 355 of the flow divider 220 extends into the conduit 210, is planar to the conduit 210 outlet, or is separated from the outlet of the conduit 210. In various embodiments, a width of the shoulder feature 375 may facilitate flow of water from the conduit 210 outlet to one or more of the splitter walls (i.e., one or more of the splitter walls 243, 247, 253, 257, 233, 237) and into one or more of the channels 240, 245, 250, 255, 230, 235. Each of the splitter walls (splitter walls 247 and 233 are shown) may be structured to increase in height with decreasing distance from the flow divider 220. Accordingly, each of the splitter walls 233, 247 may include a curved or sloped region 395, where a height of each splitter wall may increase to a plateau 390, which may be disposed adjacent to the outlet of the conduit 210 when the conduit 210 is coupled to the distribution tray 100. In various embodiments, each of the splitter walls 233, 247 (along with the remaining splitter walls 243, 253, 257, 237) may include one or engagement features 380 extending from the end 370 of splitter wall abutting the flow divider 220, where the engagement features 380 are configured to engage with the outlet of the conduit 210 to facilitate coupling (e.g., snap fit) of the conduit 210 to the distribution tray. In various embodiments, the one or more engagement features 380 may be structured to have a substantially triangular cross-section. In other embodiments, the one or more engagement features 380 may include one or more ridges, grooves, knobs, or any other protruding feature configured to engage with the conduit 210 to facilitate coupling to the distribution tray 210. In various embodiments, the one or more engagement features 380 may be configured to facilitate locating the conduit 210 concentrically with the flow divider 220.

Figure 7:
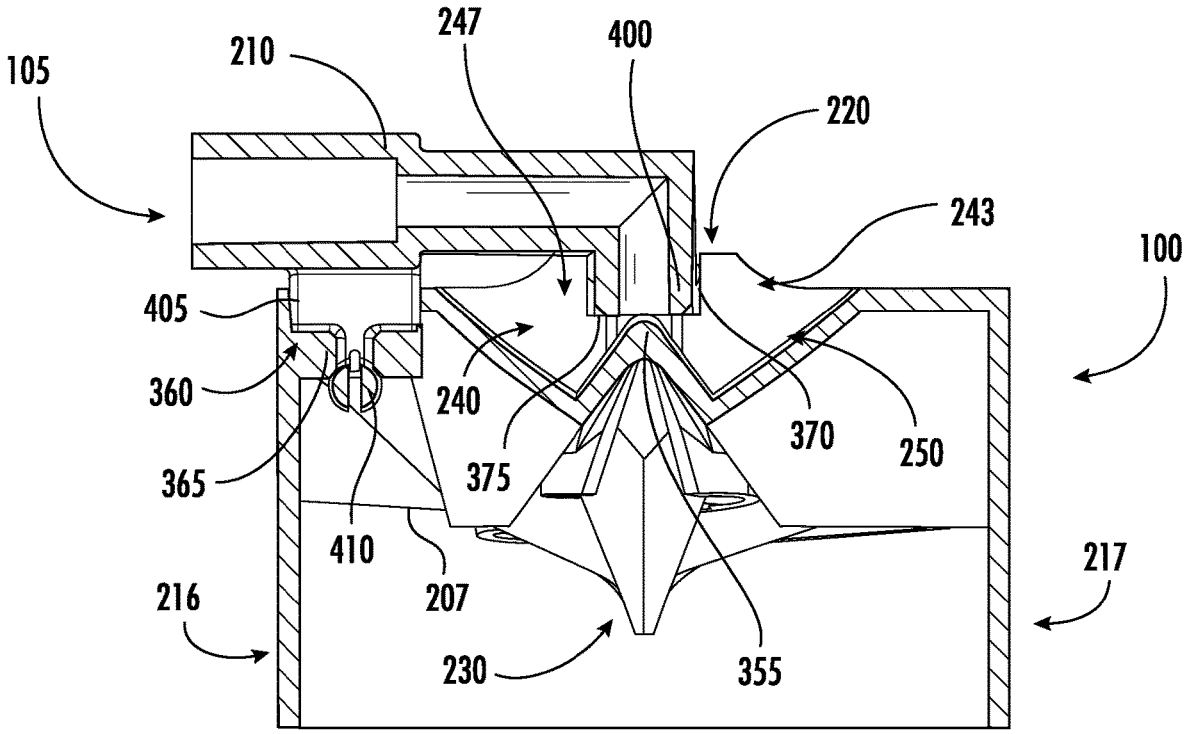
FIG. 7 is a side cross-sectional view of the distribution tray and water supply of FIG. 2A near the receiving portion of the distribution tray, taken along line 7-7 of FIG. 3.

FIG. 7, which shows a side cross-sectional view of the distribution tray 100 coupled to the conduit 210, illustrates engagement of the conduit 210 with the distribution tray 100. As shown, an end 400 of the conduit 210 is received between ends 370 of the splitter walls (i.e., splitter walls 243, 247, 253, 257, 233, 237), where horizontal (i.e., in the direction of either of the sides 216, 217) movement of the conduit 210 is prevented by the ends 370 of the splitter walls, and vertical (i.e., in the direction perpendicular to the surface 207) movement of the conduit 210 is prevented by the shoulder features 375 of each splitter wall. In addition, as shown, the conduit 210 may include an anchor portion 405, which is configured to be received within the recess 360. The anchor portion 405 may include one or more clips, balls, or other protruding features 410 configured to be received within and engage with the socket 365, where engagement of the one or more features 410 with the socket 365 may prevent separation of the conduit 210 from the distribution tray 100.

In various embodiments, the distribution tray 100 may include one or more additional retention features to facilitate attachment to other components within the humidifier assembly 10. For example, the distribution tray 100 may include one or more retention features to facilitate attachment of the distribution tray 100 to at least one of the housing 103 or water panel 110. In other embodiments, the distribution tray 100 may be structured such that it may be mounted within the humidifier assembly 10 to be out of level. In other embodiments, the distribution tray 100 may be structured such that water may flow from the flow divider 220 to each of the channels 230, 235, 240, 245, 250, 255 with up to approximately 3 degrees of tilt around an axis perpendicular to sides 216 and 217 such that side 218 is positioned higher than side 219 (or vice versa) of the distribution tray 100.

Figure 8:
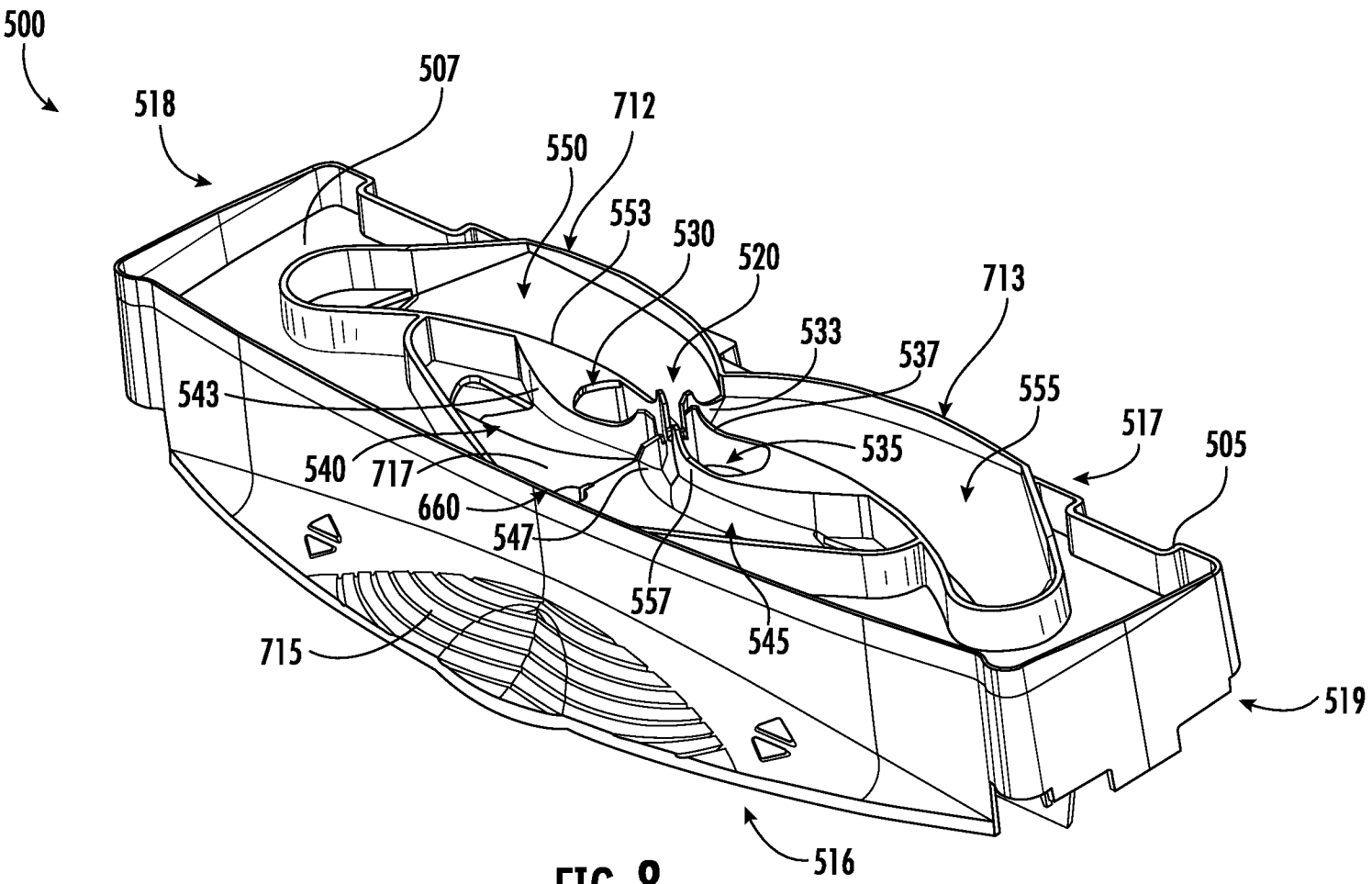
FIG. 8 is a top perspective view of a distribution tray within the humidifier assembly of FIG. 1, according to anther embodiment.
Figure 9:
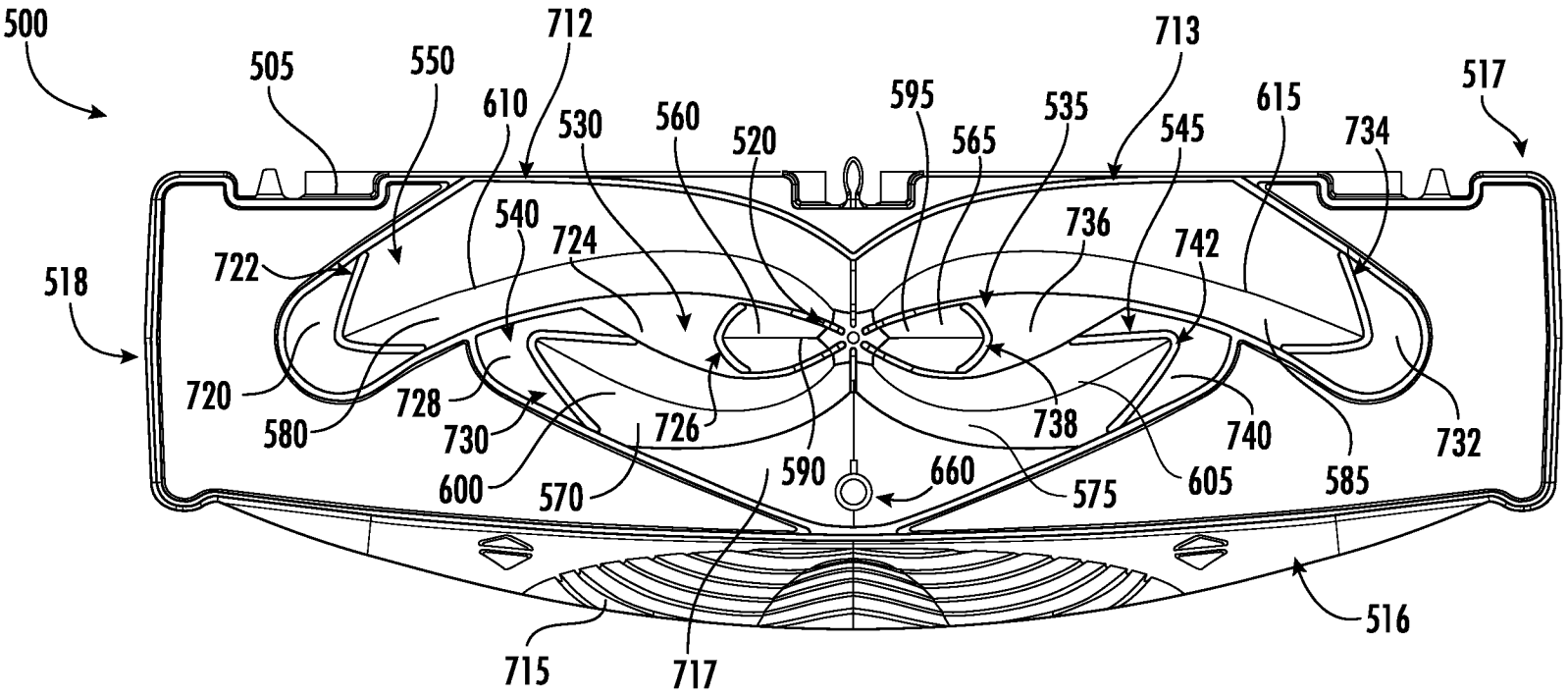
FIG. 9 is a top view of the distribution tray of FIG. 8.
Figure 10:
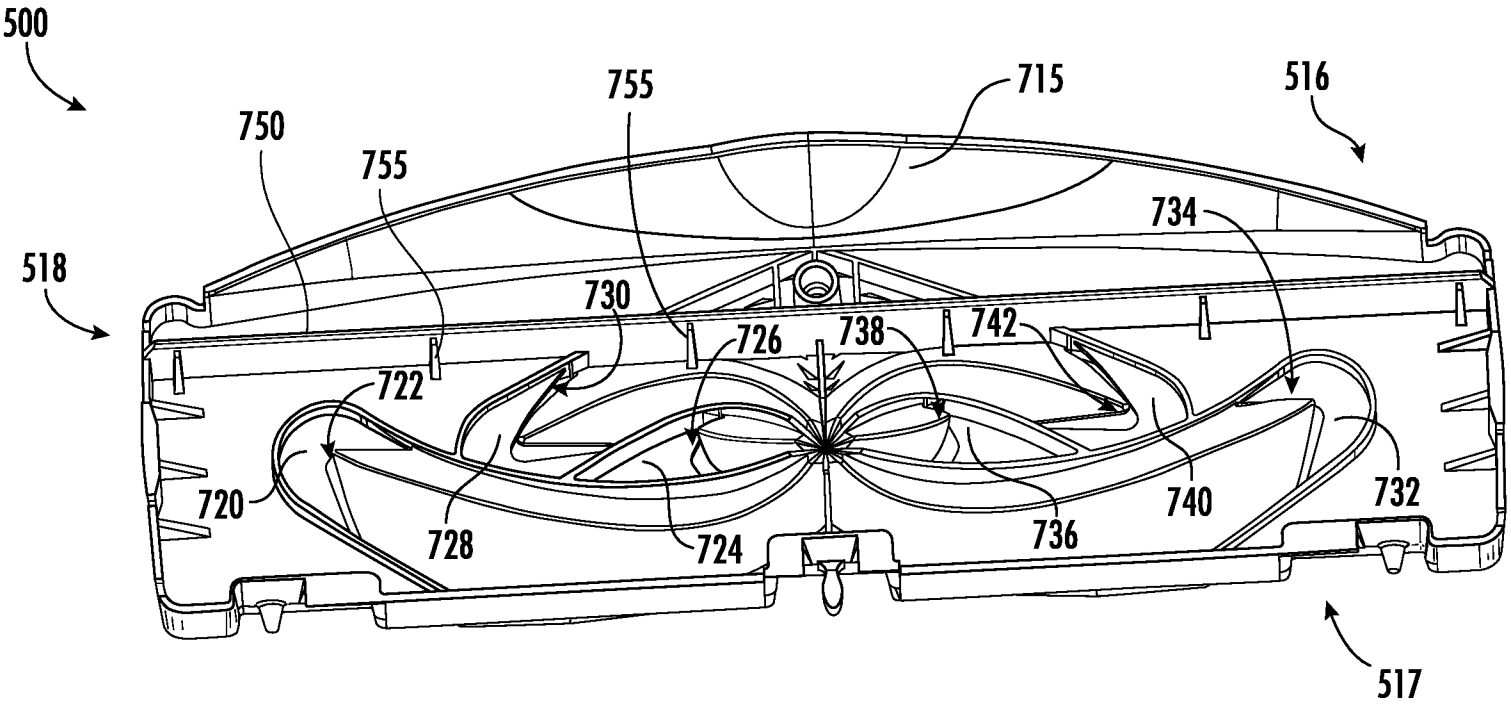
FIG. 10 is a bottom view of the distribution tray of FIG. 8.

FIGS. 8-10 show a distribution tray 500, structured to fit within the humidifier assembly 10, according to an exemplary embodiment. In various embodiments, the distribution tray 500 is similar or equivalent to the distribution tray 100. Accordingly, elements 205-410 of the distribution tray 100 are respectively substantially equivalent to elements 505-710 of the distribution tray 500. In other embodiments, such elements may be varied to accommodate alternative designs. In various embodiments, the distribution tray 500 may be further structured to reduce splashing and/or scale buildup within the distribution tray 500. Accordingly, as shown in FIG. 8, each of the channels 530, 535, 540, 545, 550, and 555 may be structured such that a bottom surface of each channel (i.e., a top surface of each of the leaves 560, 565, 570, 575, 580, and 585) is spaced a distance from an upper edge or upper surface of each of the splitter walls 543, 547, 553, 557, 533, and 537. In various embodiments, the distance between the upper edge of each of the splitter walls 543, 547, 553, 557, 533, and 537 and a bottom surface of each of the channels 530, 535, 540, 545, 550, and 555 is uniform throughout each respective channel. In other embodiments, the distance between the upper edge of each of the splitter walls 543, 547, 553, 557, 533, and 537 and a bottom surface of each of the channels 530, 535, 540, 545, 550, and 555 is variable and may be greater or smaller based on an incline of each respective leaf 560, 565, 570, 575, 580, and 585.

In some embodiments, the distribution tray includes at least one containment wall structured to prevent water from splashing outside of the distribution tray 500. For example, as shown in FIG. 8, the distribution tray 500 may include a first containment wall 712 disposed adjacent the channel 550 and a second containment wall 713 disposed adjacent the channel 555, where each of the containment walls 712, 713 extend upward from the support surface 507. As shown, an uppermost edge of each of the first and second containment walls 712, 713 are spaced a distance from a bottom surface of each of the respective channels 550, 555. Accordingly, water flowing to each of the channels 550, 555 from the receiving portion or flow divider 520 is retained within the channels as any turbulent or splashing water may be retained by the containment walls 712, 713. In various embodiments, the distance from the bottom surface of the channels 550, 555 and the uppermost edge of the first and second containment walls 712, 713 is constant along a length of the channels 550, 555. In other embodiments, the distance between the bottom surface of the channels 550, 555 and the uppermost edge of the containment walls 712, 713 is varied along the length of the channels 550, 555. For example, in some embodiments, the distance between the bottom surface of the channels 550, 555 and the uppermost edge of the containment walls 712, 713 may be greatest at an end of the channels 550, 555 that is nearest the flow divider 520. In other embodiments, the distance between the bottom surface of the channels 550, 555 and the uppermost edge of the containment walls 712, 713 may be greatest at an end of the channels 550, 555 that is furthest from the flow divider 520. In some embodiments, the containment walls 712, 713 may be disposed adjacent the retention wall 505. In other embodiments, the containment walls 712, 713 may be spaced from the retention wall 505.

In various embodiments, the distribution tray 500 may be structured to minimize water splashing and/or evaporation upstream of the water panel 10. As shown in FIGS. 9-10, each of the channels 530, 535, 540, 545, 550, and 555 may be structured to minimize an opening formed at terminal ends of the leaves 560, 565, 570, 575, 580, and 585. In various embodiments, each of the channels 550, 555, 530, 535, 540, and 545 may each include a ledge 720, 732, 724, 736, 728, and 740 disposed at respective ends of each channel. The ledges 720, 732, 724, 736, 728, and 740 may be structured as substantially horizontal surfaces extending from the ends of each of the respective channels 550, 555, 530, 535, 540, and 545 toward the corresponding leaves 580, 585, 560, 565, 570, and 575 respectively contained therein.

In various embodiments, each of the ledges 720, 732, 724, 736, 728, and 740 may be sloped downward such that water splashed out of the channels 530, 535, 540, 545, 550, and 555 onto the ledges may flow downward toward the water panel 10. In some embodiments, the ledges 720, 732, 724, 736, 728, and 740 may be sloped upward to block any water splashing up from the channels 530, 535, 540, 545, 550, and 555 and/or the water panel. In yet other embodiments, one or more of the ledges 720, 732, 724, 736, 728, and 740 may be structured to partially overlap the respective ends of the leaves 560, 565, 570, 575, 580, and 585.

As shown in FIGS. 9-10, the ledges 720, 732, 724, 736, 728, and 740 may be spaced from an end of each of the leaves 560, 565, 570, 575, 580, and 585 to form gaps 722, 734, 726, 738, 730, and 742 in each of the channels 530, 535, 540, 545, 550, and 555, respectively. Each of the gaps 722, 734, 726, 738, 730, and 742 is formed between an end of the leaves 560, 565, 570, 575, 580, and 585 and the corresponding ledge 720, 732, 724, 736, 728, and 740. In various embodiments, the gaps 722, 734, 726, 738, 730, and 742 are structured to minimize an amount of backsplash from water distributed to the water panel 10 from each of the corresponding leaves 560, 565, 570, 575, 580, and 585. In some embodiments, each of the ledges 720, 732, 724, 736, 728, and 740 has a shape that is complementary to a shape of the end of each respective leaf 560, 565, 570, 575, 580, and 585. In some embodiments, each of the gaps 722, 734, 726, 738, 730, and 742 may have a same size or width. In other embodiments, the gaps 722, 734, 726, 738, 730, and 742 may have different sizes or widths.

In various embodiments, the structure of the ledges 720, 732, 724, 736, 728, and 740 may reduce air leakage through the distribution tray 500. Reducing air leakage, together with reducing backsplash of water flowing through the distribution tray 500 may increase efficiency of the humidifier system 10 by preventing premature water evaporation and/or excessive scale buildup within the distribution tray 500 and by improving airflow through the water panel. In some embodiments, the ledges 720, 732, 724, 736, 728, and 740 are structured to reduce potential leakage of air through the corresponding gaps 722, 734, 726, 738, 730, and 742, which could lead to excess water turbulence, backflow, etc. Accordingly, the ledges 720, 732, 724, 736, 728, and 740 may facilitate streamlined water flow from the flow divider 520 along each of the leaves 560, 565, 570, 575, 580, and 585 to the water panel with minimal premature evaporation (i.e., evaporation upstream of the water panel 10). In some embodiments, the ledges 720, 732, 724, 736, 728, and 740 may be contoured to facilitate unidirectional airflow through each of the gaps 722, 734, 726, 738, 730, and 742. In various embodiments, the ledges 720, 732, 724, 736, 728, and 740 and/or the gaps 722, 734, 726, 738, 730, and 742 may be sized or shaped based on a desired airflow through the distribution tray 500.

In various embodiments, the distribution tray 500 may be adapted such that a water source (e.g., feed tube, conduit, etc.) may extend through a top surface of the distribution tray 500. As shown in FIG. 8, the distribution tray may include a recess or aperture 660 disposed within a floor portion 717 of the support surface 507, where the aperture 660 is sized to accommodate at least a portion of the feed tube such that the feed tube may provide water to the distribution tray 500 to be distributed to the water panel 110. In various embodiments, the recess 660 may include one or more seals (e.g., o-ring) disposed about a perimeter of the recess 660 to prevent water leakage therethrough. As shown in FIGS. 8-10, the floor portion 717 defines an upper surface within the distribution tray 500 that is formed above or atop the support surface 507 and extends from an inner region of the retention wall 505 to the splitter walls 543 and 557. As shown, the floor portion 717 may be structured to slope downward toward the channels 540 and 545 such that water from the floor portion 717 (e.g., spilled or leaked from a conduit disposed through the aperture 660, droplets splashed from elsewhere in the distribution tray) may flow toward the channels 540 and 545.

In some embodiments, the distribution tray 500 may be structured to facilitate ease of assembly and/or positioning within the humidifier system 10. As shown, the distribution tray 500 may include at least one handle 715, extending from an outer edge of the retention wall 505. In some embodiments, the at least one handle 715 may enable gripping of the distribution tray 500 to facilitate placement and/or installation within the humidifier system 10. In various embodiments, such as shown in FIG. 10, the distribution tray 500 may include at least one placement wall 750, which may extend from a bottom side of the support surface 507 (i.e., on a side facing opposite the side of the support surface 507 upon which the floor portion 717 and flow divider 520 are disposed). In various embodiments, the placement wall 750 may be structured to align with a portion of the water panel 110 and/or housing 103 to couple distribution tray 500 thereto.

In some embodiments, the placement wall 750 may include one or more ribs 755 extending from the support surface 507 toward a terminal edge of the placement wall 750. As shown in FIG. 10, the ribs 755 may be spaced along the placement wall 750 such that each rib 755 is separated a distance from the next adjacent rib 755. In some embodiments, each rib 755 may have a uniform thickness. In other embodiments, each rib 755 may have a varying thickness. In yet other embodiments, each rib 755 may have a thickness that increases with proximity to the support surface 507 (i.e., decreases with proximity to a terminal edge of the placement wall 750). In various embodiments, the ribs 755 may be structured to facilitate placement and retention of the distribution tray 500 within the humidifier system 10. For example, the ribs 755 may facilitate a friction or interference fit with one or more components of the water panel 110 and/or housing 103.

Notwithstanding the embodiments described above in FIGS. 1-10, various modifications and inclusions to those embodiments are contemplated and considered within the scope of the present disclosure.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains.

Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A distribution tray for a humidifier, the distribution tray comprising:

a surface;

a flow divider disposed on the surface, the flow divider configured to receive a flow of water; and a plurality of channels, wherein each channel of the plurality of channels is fluidly coupled to the flow divider and configured to receive water from the flow divider;

wherein each channel defines a flow path, and wherein each flow path increases in slope along a length of each channel.

2. The distribution tray of claim 1, wherein the distribution tray is rectangular in shape, having a first side, a second side opposite the first side, a third side substantially perpendicular to the first side, and a fourth side opposite the third side.

3. The distribution tray of claim 2, wherein a first channel of the plurality of channels extends toward the third side and a second channel of the plurality of channels extends toward the fourth side.

4. The distribution tray of claim 2, wherein the flow divider is disposed at a midpoint between the first side and the second side.

5. The distribution tray of claim 2, wherein the flow divider has one of a conical shape or a spherical shape.

6. The distribution tray of claim 2, wherein the slope of the flow path is greatest at an end of the channel.

7. The distribution tray of claim 6, wherein the flow path is configured to curve in a first direction and a second direction, the second direction being perpendicular to the first direction.

8. A distribution tray for a humidifier, the distribution tray comprising:

a surface enclosed by a retaining wall; and a flow divider disposed on the surface at a point between opposite sides of the retaining wall, the flow divider configured to receive a flow of water;

wherein the flow divider is fluidly coupled to a plurality of channels, each of the plurality of channels being disposed equidistantly about a circumference of the flow divider and configured to receive a portion of the flow of water;

wherein each of the plurality of channels includes a leaf portion, the leaf portion defining a flow path, and wherein the flow path has a varying slope along a length of the leaf portion.

9. The distribution tray of claim 8, wherein the slope is greatest at a terminal end of the leaf portion.

10. The distribution tray of claim 8, wherein the flow path corresponding to a longest of the plurality of channels has a greatest radius of curvature nearest the flow divider and the flow path corresponding to a shortest of the plurality of channels has a smallest radius of curvature nearest the flow divider.

11. The distribution tray of claim 8, wherein the plurality of channels comprises six channels.

12. The distribution tray of claim 8, wherein each of the plurality of channels is formed between two splitter walls, each splitter wall extending from the flow divider toward the retaining wall.

13. The distribution tray of claim 8, wherein the leaf portion comprises a plurality of ribs, the plurality of ribs configured to facilitate water beading.

14. The distribution tray of claim 8, further comprising a treated surface, the treated surface configured to have a lowered surface energy as compared to an untreated version of the distribution tray.

15. A humidifier comprising:

a conduit configured to facilitate water flow from a water supply; and a distribution tray fluidly coupled to the conduit, the distribution tray comprising:

a surface enclosed by a retaining wall;

a flow divider disposed on the surface, the flow divider configured to receive water from the conduit; and a plurality of channels, each of the plurality of channels being defined between two splitter walls, wherein each of the plurality of channels is configured to receive a portion of the water;

wherein each of the plurality of channels includes a leaf portion, the leaf portion defining a flow path, and wherein the flow path has a varying slope along a length of the leaf portion; and wherein an outlet of the conduit is configured to be placed between ends of the two splitter walls.

16. The humidifier of claim 15, wherein each of the ends of the two splitter walls comprises a shoulder, the shoulder configured to prevent downward motion of the outlet.

17. The humidifier of claim 16, wherein the flow divider is conical in shape.

18. The humidifier of claim 17, wherein a position of an apex of the flow divider relative to the outlet is based on a height of the ends of the two splitter walls.

19. The humidifier of claim 15, wherein the conduit is an elbow.

20. The humidifier of claim 19, wherein the distribution tray further comprises a recess disposed adjacent a side of the retaining wall, wherein the recess is configured to receive an anchor portion of the conduit.

* * * * *